United States Patent [19]

Collins

[11] 4,414,744

[45] Nov. 15, 1983

[54] KNIFE AND SHEATH

[75] Inventor: Walter W. Collins, Clover, S.C.

[73] Assignee: Schur, Inc., Framingham, Mass.

[21] Appl. No.: 287,916

[22] Filed: Jul. 29, 1981

[51] Int. Cl.[3] ..... B26B 29/02

[52] U.S. Cl. ..... 30/151; 224/232; 224/242

[58] Field of Search ..... 30/151, 143, 162; 7/167; 224/242, 232, 233; 220/326

[56] References Cited

U.S. PATENT DOCUMENTS

| | | | |
|---|---|---|---|
| 501,689 | 7/1893 | Oldenbusch | 220/326 |
| 3,241,237 | 3/1966 | Eastman | 30/151 X |
| 4,114,787 | 9/1978 | Rosenkaimer | 224/232 X |

*Primary Examiner*—E. R. Kazenske
*Assistant Examiner*—Douglas D. Watts

[57] ABSTRACT

Device for locking a knife having a pommel projecting from the knife handle into a sheath, comprising a rigid ring pivotally supported on the hanger portion of the sheath and adapted to be pivoted from a locking position about the pommel into a non-locking position, in which the ring lies in a plane parallel to the length of the knife when the knife is in the sheath. A leaf spring with one end fixed to the sheath engages a dog projecting from the base of the ring for selectively spring-loading the ring in either a non-locking position or a locking position in which the ring engages the pommel.

3 Claims, 3 Drawing Figures

KNIFE AND SHEATH

SUBJECT MATTER OF INVENTION

The present invention relates to a means for securing a knife in a sheath against inadvertent dislodgement.

BACKGROUND OF INVENTION

Most sheaths that have been designed for carrying knives are intended to permit the knife to be pulled quickly from the sheath. In some instances, straps with snap fasteners have been provided to secure the knife in the sheath against accidental dislodgement. In knives and sheaths designed for use by divers the sheath has frequently been provided with a flexible, stretchable rubber or rubber-like loop that can be stretched over the handle to secure it in place.

While such means for securing a knife in a sheath are adequate for most purposes, they have limitations, especially when the knife is worn in unusual environmental situations such as occur when the knife is carried by divers.

Divers have use for a knife and sheath combination in which the knife will remain securely in the sheath during normal movements of the diver, but which can be quickly and easily removed by the diver when he wishes. The sheath construction most commonly used by divers has been a sheath with a rubber-like ring. That construction, while securely holding the knife in the sheath during normal movement of the diver, does not permit easy removal of the knife. The rubber ring has to be stretched and distended by the diver. Since the diver works underwater and frequently in the dark, it may not always be easy to free the knife from the rubber ring and then remove it from the sheath.

SUMMARY OF INVENTION

The foregoing limitations on the previously available knife and sheath combinations are addressed in the present invention. In the present invention there is provided a knife and sheath combination especially adapted for use by divers. The knife has a blade and a handle terminating in a projecting pommel. The sheath consists of a blade engaging portion having an integral hanger. The hanger is adapted to the sheath such that it lies adjacent to the knife handle when the knife blade is inserted in the blade engaging portion. A lock means is pivotally supported on the hanger portion of the sheath. A two position spring loaded lock means either engages the pommel to hold the knife in the sheath or does not engage the pommel thereby allowing easy removal or insertion of the knife out of or into the sheath. This sheath and knife combination is particularly designed to withstand a wide variety of adverse conditions encountered in underwater use. As a further object and advantage of the present invention a knife and sheath combination is provided having a positive mechanical locking member for securing the knife in the sheath. This mechanical locking configuration is designed for convenient insertion and removal of the knife from the sheath with the locking mechanism adequate to secure the knife against accidental removal.

A further object of the present invention is to provide a knife and sheath combination having minimal mechanical components of simple and inexpensive design.

DETAILED DESCRIPTION OF DRAWINGS

The foregoing features of the present invention will be more clearly understood in connection with a consideration of the accompanying drawings in which.

DETAILED DESCRIPTION OF PRESENT INVENTION

Figure 1:
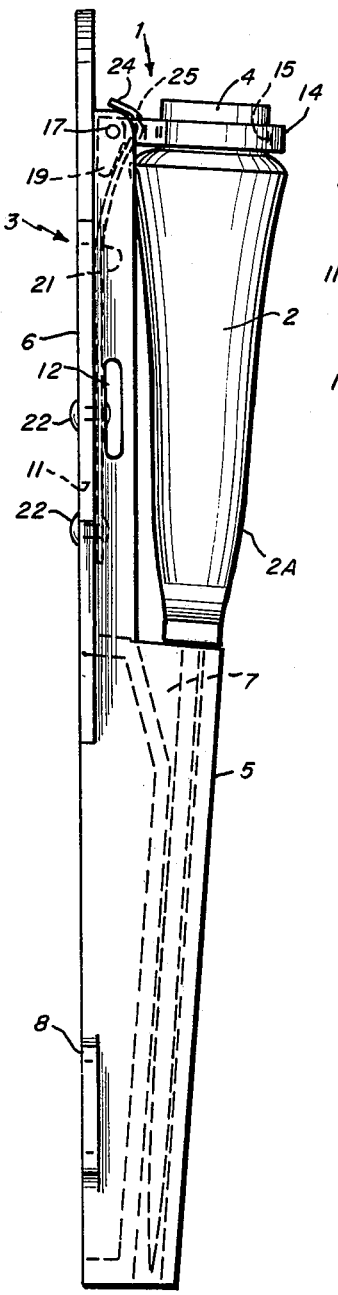
FIG. 1 is a side view of a knife and sheath embodying the present invention.
Figure 2:
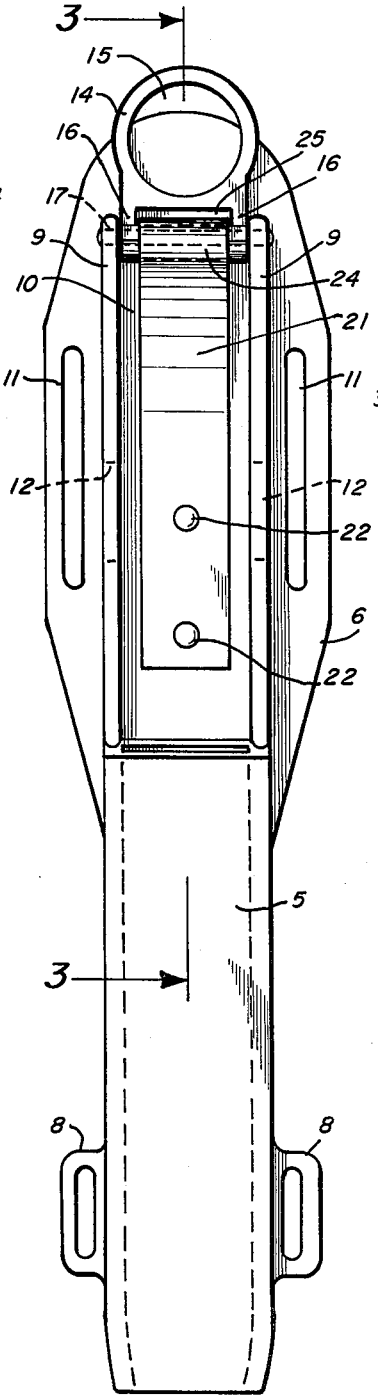
FIG. 2 is a front view of the sheath with the locking mechanism in an open position.

The present invention generally relates to a locking means 1 for securing a knife 2 to a sheath 3. The knife 2 is preferably a knife especially designed for use by divers. These knives are generally sturdy, solid knives having heavy handles 2A. The handle 2A is integrally formed with a pommel 4 that extends outwardly from the end of the handle symmetrically about the longitudinal axis of the knife. In the preferred form the pommel 4 is formed of metal and is cylindrically shaped.

The sheath 3 is preferably formed of an integral member made of plastic or rubber. The lower end of the sheath is provided with a blade encasing or engaging portion 5 and an integrally formed hanger 6. The blade engaging portion 5 is preferably formed with a diverging opening 7 shaped to easily receive the pointed end of the knife. A pair of slotted tabs 8 may be provided at the lower end of the blade engaging portion 5 for a strap.

The hanger 6 is preferably formed with a pair of longitudinally extending ribs 9 that project from the outer face 10 of the sheath. Additional slots 11 and 12 may be provided in the hanger 6 for a belt.

A ring 14 is formed with a circular opening 15 having a diameter slightly larger than the diameter of the pommel 4. the ring 14, preferably made of metal, is rigid and integrally formed with a pair of parallel flanges 16 through which a pin 17 extends. The ends of the pin 17 are appropriately locked in the opposite ribs 9 to form a hinge for the ring 14.

Also integrally formed with the ring 15 is a dog 19 that projects normally from the plane in which the opening 15 lies. The dog 19 extends laterally between the flanges 16 and forms a detent for selective engagement by a leaf spring 21.

Figure 3:
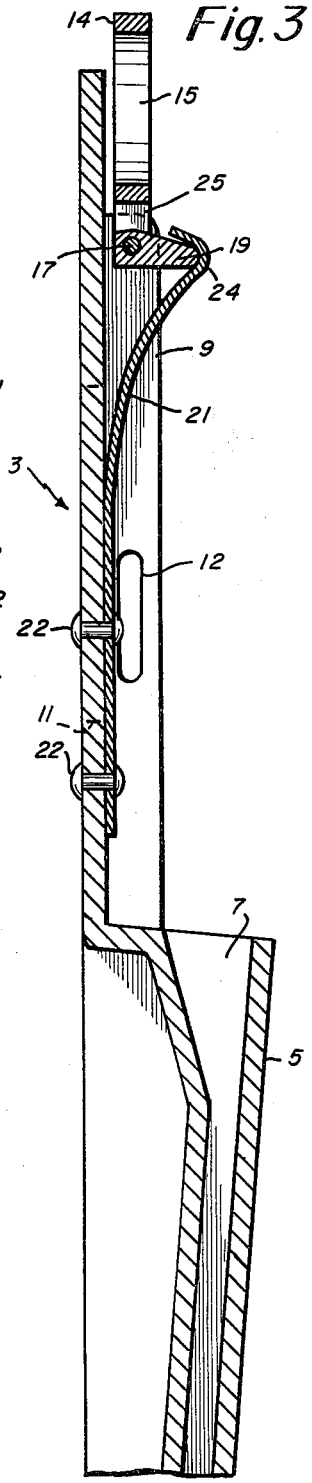
FIG. 3 is a cross-sectional view of the sheath taken along line 3—3 of FIG. 2.

Leaf spring 21 comprises an elongated resilient metal spring that is secured at one end to the hanger 6 between ribs 9 by rivets 22. The other end of the leaf spring 21 is bent into a hook shaped configuration 24 that is adapted to engage the end of the dog 19 when the ring is in an open or unlocked position as illustrated in FIG. 3. In a locked position, as illustrated in FIG. 1, the end 24 of the spring 21 projects through a slot 25 that extends laterally between the flanges 16 as illustrated in FIG. 1.

In the use of this knife and sheath, the locking device 1 operatively secures the knife 2 in the sheath in the position illustrated in FIG. 1. In this arrangement the ring 14 fits about the pommel 4 and is secured in this position against accidental dislodgement by the pressure of leaf spring 21. To remove the knife from the sheath, the ring 14 is pivoted, preferably by one finger or thumb, 90 degrees from the position illustrated in FIG. 1 to the position illustrated in FIG. 3. The knife is thus free to be removed from the sheath. In the position illustrated in FIG. 3 the ring is secured in its upward position by the spring 21 in its engagement with the dog 19. When the knife is to be returned to the sheath, the ring 14 is not in the way. As the knife is lowered into position, the ring is re-engaged with the pommel 4 by one's hand as the knife is moved into the sheath.

If there is inadvertent upward movement of the knife against the ring before the ring is disengaged from the pommel, the pommel and ring will bind and thereby prevent accidental removal of the knife from the sheath. It should be understood that the preferred embodiment described above shows only one of many uses for the unique knife and sheath combination of the present invention. Furthermore, the use of other materials for the sheath and locking mechanism as well as other arrangements for the spring and dog should occur to those skilled in the art after reading the above description and are intended to be included within the scope of the present invention. Therefore, I claim and seek to obtain a Patent for the following:

I claim:

1. In combination a knife having a handle terminating in a projecting pommel and a blade, a sheath having a blade engaging portion and a hanger integral therewith, said hanger adapted to lie adjacent to said knife handle when the knife blade is inserted in said blade engaging portion, and lock means comprising a pommel engaging member, means pivotally supporting said pommel engaging member on said hanger and spring means selectively spring loading said pommel engaging member in either nonlocking or locking engagement with said pommel;

wherein said means pivotally supporting said pommel engaging member includes a hinge supported in part by said hanger, and a dog integrally formed on said pommel engaging member adapted to be engaged by said spring;

wherein said pommel engaging member comprises a rigid ring shaped to conform with and engage the periphery of said pommel and supported by said hinge for pivotal movement between a locking position in which the diameters of the ring are in a plane normal to the length of the knife when positioned in the sheath to a nonlocking position in which the diameters of the ring are in a plane substantially parallel to the length of the knife;

wherein said dog extends normally from the plane containing the diameters of said ring;

wherein said spring means comprises a leaf spring with one end secured to said hanger and the other engageable with said dog when said pommel engaging member is in nonlocking position; and wherein said pommel engaging member further includes a slot extending parallel to the axis of said hinge and sized to permit said other end of said spring to project therethrough on movement of said pommel engaging member to said locking position.

2. A combination as set forth in claim 1 wherein said pommel is cylindrical in shape with its axis parallel to the length of said knife.

3. A combination as set forth in claim 2 wherein said sheath is integrally formed with a pair of longitudinally extending ribs, said ribs in part forming a support for said hinge.

* * * * *